US010883484B2

(12) United States Patent
Lee et al.

(10) Patent No.: US 10,883,484 B2
(45) Date of Patent: Jan. 5, 2021

(54) RECIPROCATING COMPRESSOR

(71) Applicant: LG Electronics Inc., Seoul (KR)

(72) Inventors: Jongkoo Lee, Seoul (KR); Sungchul Gong, Seoul (KR); Jeonguk Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 145 days.

(21) Appl. No.: 15/887,423

(22) Filed: Feb. 2, 2018

(65) Prior Publication Data

US 2018/0223822 A1 Aug. 9, 2018

(30) Foreign Application Priority Data

Feb. 3, 2017 (KR) ..... 10-2017-0015469

(51) Int. Cl.
*F04B 39/10* (2006.01)
*F04B 39/00* (2006.01)
(Continued)

(52) U.S. Cl.
CPC ..... *F04B 39/1066* (2013.01); *F04B 7/04* (2013.01); *F04B 35/045* (2013.01);
(Continued)

(58) Field of Classification Search
CPC ..... F04B 35/045; F04B 39/0016; F04B 39/1066; F04B 39/1073; F04B 53/1037;
(Continued)

(56) References Cited

U.S. PATENT DOCUMENTS 5,452,994 A * 9/1995 Erickson ..... F04B 39/0016 417/550
6,152,710 A * 11/2000 Oh ..... F04B 35/045 417/570

(Continued)

FOREIGN PATENT DOCUMENTS

CN 1146533 4/1997
CN 1221857 7/1999

(Continued)

OTHER PUBLICATIONS

European Extended Search Report in European Application No. 18154936.1, dated May 17, 2018, 8 pages.

(Continued)

*Primary Examiner* — Alexander B Comley
(74) *Attorney, Agent, or Firm* — Fish & Richardson P.C.

(57) ABSTRACT

A reciprocating compressor includes a cylinder that defines an inner space, a piston that is located in the inner space of the cylinder and that defines a compression space configured to receive refrigerant, a discharge cover that is coupled to a side of the cylinder and that defines a discharge space configured to receive refrigerant discharged from the compression space, and a valve plate that is located at a side space defined at the side of the cylinder and that partitions the side space into the compression space and the discharge space. The valve plate defines a discharge hole through (Continued)

which the compression space and the discharge space communicate with each other, in which the discharge hole includes an inlet that faces the compression space and an outlet that faces the discharge space. The inlet and the outlet have different shapes.

18 Claims, 10 Drawing Sheets

(51) Int. Cl.

| | |
|---|---|
| ***F04B 35/04*** | (2006.01) |
| ***F04B 53/12*** | (2006.01) |
| ***F04B 39/02*** | (2006.01) |
| ***F04B 7/04*** | (2006.01) |
| ***F04B 53/10*** | (2006.01) |
| ***F04B 53/14*** | (2006.01) |

(52) U.S. Cl.
CPC ..... *F04B 39/0016* (2013.01); *F04B 39/0238* (2013.01); *F04B 39/1073* (2013.01); *F04B 53/1037* (2013.01); *F04B 53/12* (2013.01); *F04B 53/128* (2013.01); *F04B 53/14* (2013.01)

(58) Field of Classification Search
CPC ..... F04B 53/12; F04B 7/04; F04B 39/0238; F04B 53/128
USPC ..... 417/550, 562, 569, 570
See application file for complete search history.

(56) References Cited

U.S. PATENT DOCUMENTS

2003/0185695 A1* 10/2003 Sieberg ..... F04B 39/1073 417/569
2013/0052066 A1* 2/2013 Moroi ..... F04B 27/1009 417/559

FOREIGN PATENT DOCUMENTS

| | | | |
|---|---|---|---|
| CN | 101014770 | | 8/2007 |
| CN | 102979698 | | 3/2013 |
| DE | 826926 | | 1/1952 |
| FR | 2996607 | | 4/2014 |
| KR | 1019990057578 | | 7/1999 |
| KR | 100176913 | | 10/1999 |
| KR | 1020000032084 | | 6/2000 |
| KR | 20030059611 | A * | 7/2003 |
| KR | 1020030059611 | | 7/2003 |
| KR | 10-2006-0039180 | | 5/2006 |

OTHER PUBLICATIONS

Chinese Office Action in Chinese Appln. No. 201810047965.4, dated Jan. 7, 2019, 16 pages (with English translation).
Chinese Office Action in Chinese Application No. 201810047965.4, dated Aug. 30, 2019, 13 pages (with English translation).

* cited by examiner

RECIPROCATING COMPRESSOR

CROSS-REFERENCE TO RELATED APPLICATIONS

This application claims priority under 35 U.S.C. 119 and 35 U.S.C. 365 to Korean Patent Application No. 10-2017-0015469 filed on Feb. 3, 2017, in Korea, the entire contents of which is hereby incorporated by reference in its entirety.

FIELD

The present disclosure relates to a reciprocating compressor.

BACKGROUND

A compressor may receive power from a power generating device such as an electric motor and a turbine, and increase pressure by compressing air, refrigerant, or various types of working fluid. The compressor has been widely used in home appliances such as a refrigerator and an air conditioner, and in the industry.

The compressor may be classified into a reciprocating compressor, a rotary compressor, and a scroll compressor based on a compression scheme for a working fluid.

For example, the reciprocating compressor may include a cylinder, and a piston provided inside the cylinder and configured to linearly reciprocate in the cylinder. The reciprocating compressor may have a compression space between a piston head and the cylinder, and the compression space may increase or decrease based on linear reciprocating movement of the piston, in which a working fluid inside the compression space may be compressed at a high temperature at a high pressure.

The rotary compressor may include a cylinder, and a roller configured to eccentrically rotate inside the cylinder. For instance, the roller may eccentrically rotate inside the cylinder to compress the working fluid supplied to the compression space at a high temperature at a high pressure.

The scroll compressor may include a fixed scroll, and an orbiting scroll that rotates about the fixed scroll. For instance, the orbiting scroll may rotate to compress the working fluid supplied to the compression space at a high temperature at a high pressure.

In recent years, among the reciprocating compressors, a linear compressor, in which a piston is directly connected to a linearly reciprocating linear motor, has been actively developed.

For example, the linear compressor may include a piston that linearly reciprocates inside a cylinder by a linear motor in a closed shell to suction refrigerant into a compression space, compress the refrigerant, and then discharge the refrigerant.

The linear motor may include a permanent magnet that is located between an inner stator and an outer stator, and the permanent magnet may linearly reciprocate between the inner stator and the outer stator by electromagnetic force. For example, when the permanent magnet, which is connected to the piston, is driven, the piston linearly reciprocates inside the cylinder to suction, compress, and then discharge the refrigerant.

In some examples, the linear compressor may include a discharge valve configured to open and close one end of a cylinder, and a muffler that includes a discharge spring configured to support the discharge valve.

In some examples, when a pressure in a cylinder is larger than a pressure in a muffler, the discharge valve opens the cylinder, and thus refrigerant compressed by the cylinder is discharged to the muffler.

In some cases, the linear compressor may include a cylinder that is opened/closed by the discharge valve, in which an amount of noise may increase due to collision between the discharge valve and the cylinder.

In some cases, the liner compressor may have a dead volume inside the compression space. When the piston moves rearward, a high-pressure refrigerant existing inside of the dead volume may expand, and suction of the refrigerant into the compression space may be delayed, and thus a cooling power may decrease.

In some examples where a flow passage area of a discharge hole is narrow, a flow passage resistance may increase, and thus efficiency of the compressor may be deteriorated.

SUMMARY

One aspect of the present disclosure is to provide a reciprocating compressor having a new-type discharge valve assembly.

According to one aspect of the subject matter described in this application, a reciprocating compressor includes a cylinder that defines an inner space, a piston that is located in the inner space of the cylinder and that defines a compression space configured to receive refrigerant, a discharge cover that is coupled to a side of the cylinder and that defines a discharge space configured to receive refrigerant discharged from the compression space, and a valve plate that is located at a side space defined at the side of the cylinder and that partitions the side space into the compression space and the discharge space. The valve plate defines a discharge hole through which the compression space and the discharge space communicate with each other, in which the discharge hole includes an inlet that faces the compression space and an outlet that faces the discharge space. The inlet and the outlet have different shapes.

Implementations according to this aspect may include one or more of the following features. For example, the inlet may include an opening, and the outlet may include a plurality of discharge ports. The reciprocating compressor may further include a discharge valve located at the outlet and configured to open and close the discharge hole, and the discharge valve may include a plurality of flaps corresponding to the plurality of discharge ports. The reciprocating compressor may further include a valve stopper coupled to a side of the discharge valve and configured to limit movement of the plurality of flaps.

In some implementations, the piston may include a suction valve that is located at a head surface of the piston, the head surface facing the compression space, and a bolt configured to couple the suction valve to the head surface of the piston, where the discharge hole is configured to receive a head of the bolt. The inlet may have a shape corresponding to a shape of the head of the bolt. The valve plate may have a planar shape and include a first surface that faces the compression space and a second surface that faces the discharge space. The inlet may be recessed from the first surface of the valve plate toward the outlet, and the outlet may be recessed from the second surface of the valve plate toward the inlet.

In some implementations, the outlet may include three discharge ports configured to communicate with the inlet. The reciprocating compressor may further include a discharge valve coupled to a side of the discharge hole, and the discharge valve may include three flaps that correspond to the three discharge ports, in which each flap is configured to open and close one of the three discharge ports. In some examples, the valve plate may further define a sealing groove that extends along a circumferential surface of the valve plate and that is configured to receive a seal ring.

In some implementations, an area of the opening of the inlet may be greater than an area of each discharge port. The opening of the inlet may communicate with a portion of each discharge port. The inlet may include an opening defined at the first surface of the valve plate, the outlet may include a plurality of discharge ports defined at the second surface of the valve plate, and the valve plate may include grooves recessed from the second surface of the valve plate and configured to receive oil from refrigerant, in which each groove surrounds one of the plurality of discharge ports.

In some implementations, the inlet may include an inclined portion that extends from the first surface of the valve plate toward the outlet so that a diameter of the inlet may decrease toward the outlet. The piston may define a suction hole at the head surface of the piston, and the suction valve may be configured to open and close the suction hole based on movement of the piston. The suction valve may be configured to be bent to close the suction hole based on pressure in the compression space.

In some implementations, the plurality of discharge ports may be arranged about an axis of the cylinder. In some examples, each of the plurality of flaps may include a first end that is coupled to the side of the discharge valve, and a second end that is configured to open and close one of the plurality of discharge ports. The piston may further define a bolt groove located at a center of the head surface of the piston and configured to receive the bolt.

The details of one or more implementations are set forth in the accompanying drawings and the description below. Other features will be apparent from the description and drawings, and from the claims.

DETAILED DESCRIPTION

Reference will now be made in detail to the implementations of the present disclosure, examples of which are illustrated in the accompanying drawings.

The present disclosure relates to a reciprocating compressor, and hereinafter, among the reciprocating compressor, a linear compressor will be described as an example. This is illustrative, and the present disclosure may be applied even to different types of reciprocating compressors including but not limited to the linear compressor.

Figure 1:
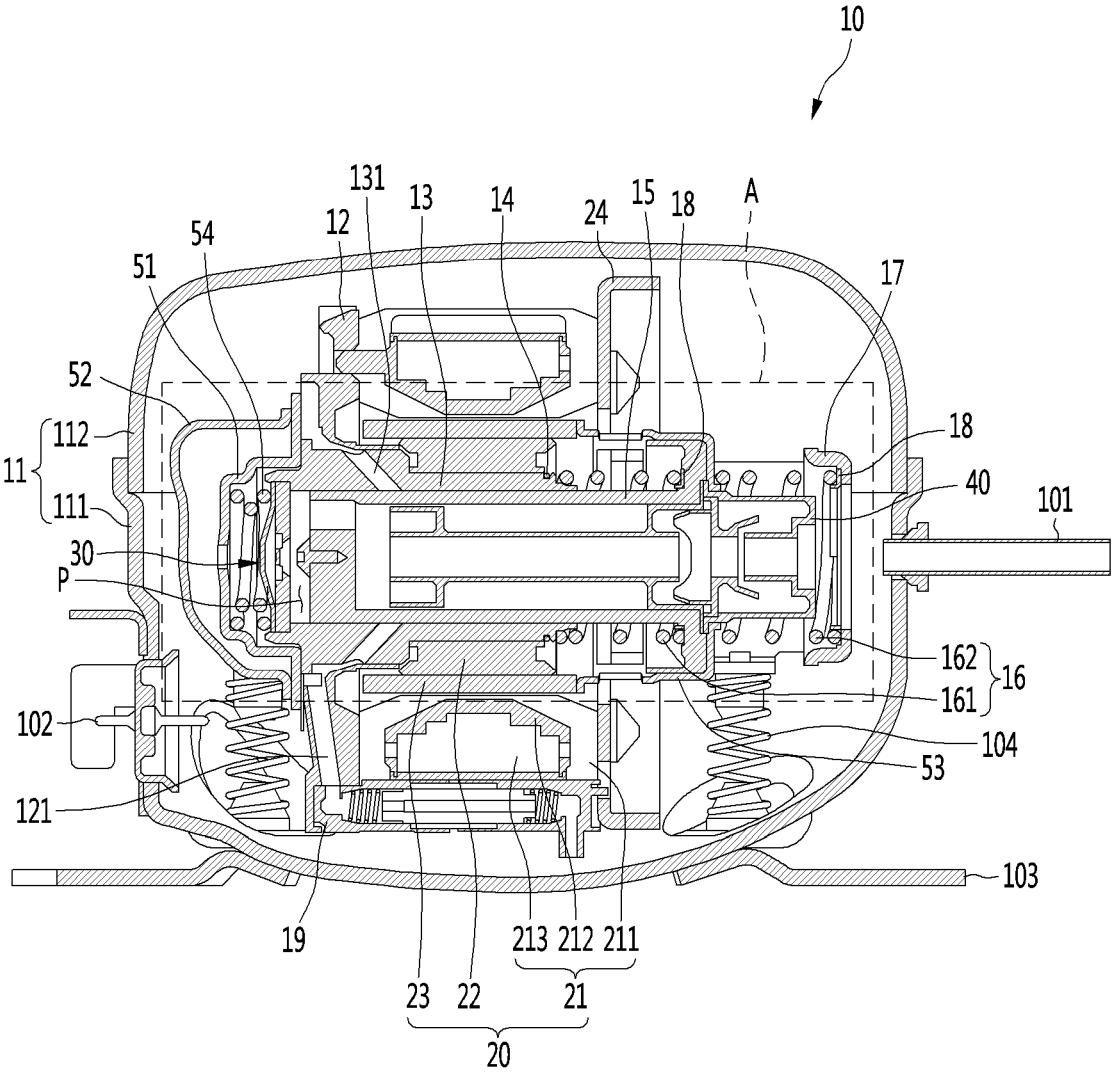
FIG. 1 is a longitudinal sectional view illustrating an example internal structure of an example compressor.
Figure 2:
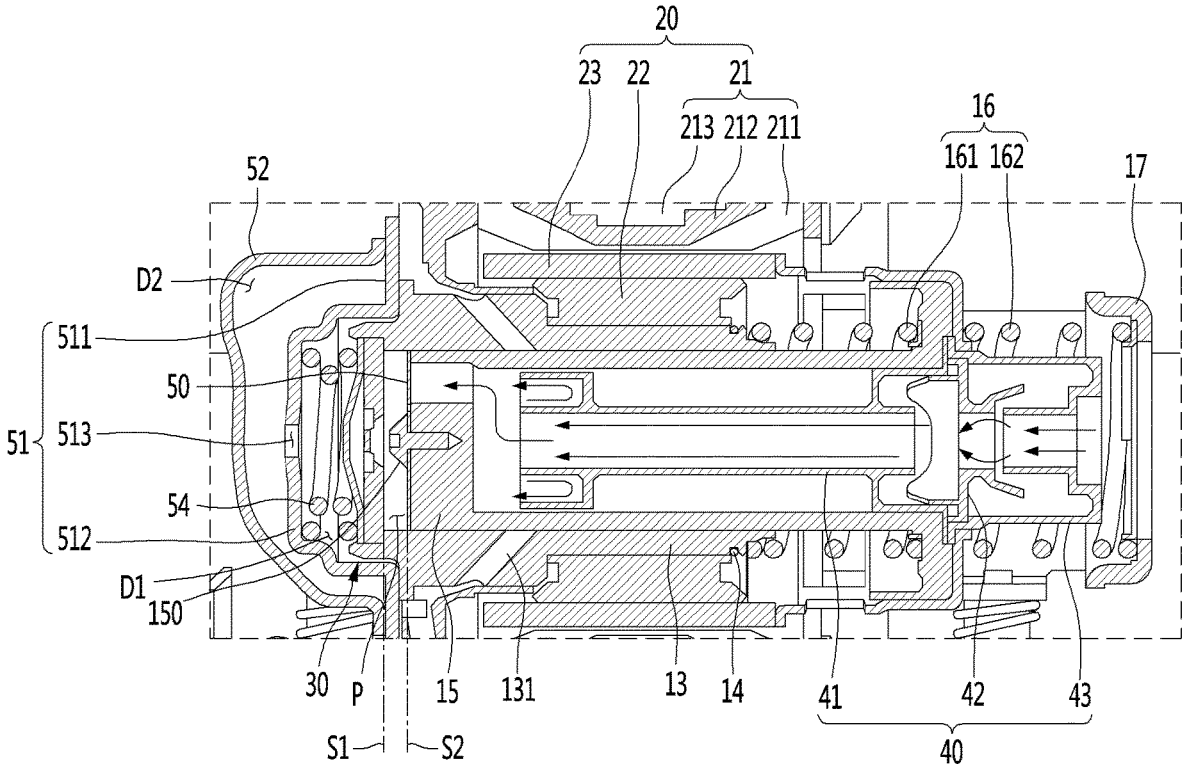
FIG. 2 is an enlarged view illustrating the part A of FIG. 1.
Figure 3:
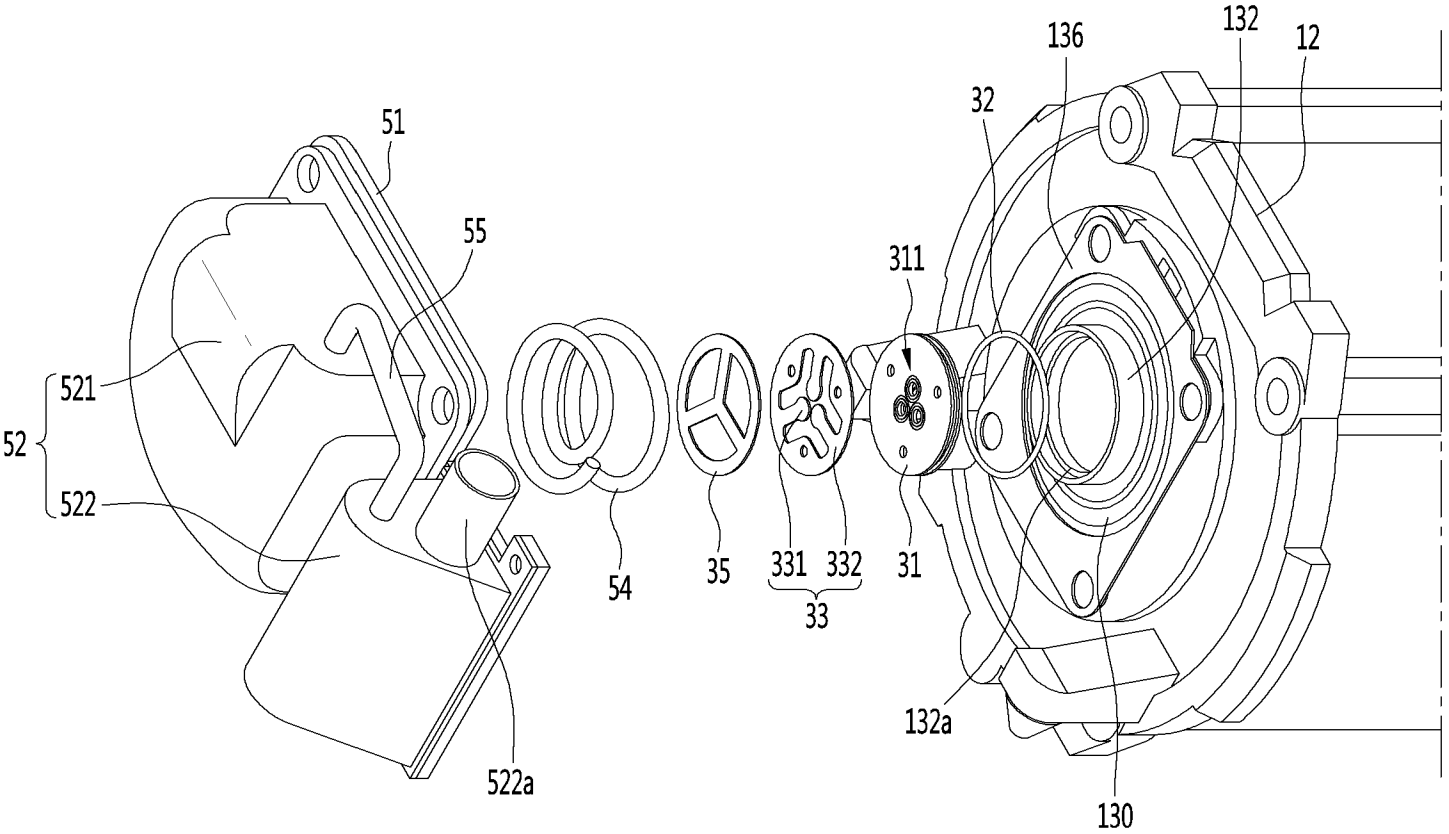
FIG. 3 is an exploded perspective view illustrating an example configuration of an example discharge system of the compressor.

FIG. 1 illustrates an example internal structure of an example compressor in a longitudinal sectional view, FIG. 2 illustrates the part A of FIG. 1 in an enlarged view, and FIG. 3 illustrates an example configuration of an example discharge system of the compressor in an exploded perspective view.

Referring to FIGS. 1 to 3, a compressor 10 (e.g., a linear compressor) may include a sealed container 11 that defines an outer appearance, a compression unit provided inside the sealed container 11, and a support spring 104 that supports the compression unit.

The sealed container 11 defines a sealed space therein that is configured to accommodate various kinds of components constituting the compressor 10. The sealed container 11 may be made of metal, and include a lower shell 111 and an upper shell 112.

The lower shell 111 may have an approximately semi-spherical shape, and the lower shell 110 and the upper shell 112 together define an accommodation space configured to accommodate the various kinds of components constituting the compressor 10. The lower shell 111 may be named as a "compressor body", and the upper shell 112 may be named as a "compressor cover".

In some implementations, an inlet pipe 101 is coupled through one surface of the lower shell 111 constituting the sealed container 11, and an outlet pipe 102 is coupled to the other surface of the lower shell 111. The inlet pipe 101 and the outlet pipe 102 may be separately mounted on the lower shell 111 or may be formed integrally with the lower shell 111.

A pipe on an outlet side of an evaporator constituting a refrigeration cycle is connected to the inlet pipe 101, and a pipe on an inlet side of the evaporator is connected to the outlet pipe 102. Thus, a low-temperature low-pressure gas refrigerant, introduced from the evaporator through the inlet pipe 101, is compressed into a high-temperature high-pressure gas refrigerant by the compressor 10, and then flows to the evaporator through the outlet pipe 102.

The support spring 104 connects a bottom surface of the compression unit and a floor of the lower shell 111, so that the compression unit is supported while being spaced apart from an inner peripheral surface of the sealed container 11.

In some examples, the compressor 10 is seated on a motor mount 103. The motor mount 103 is coupled to a lower portion of the lower shell 111 to stably support the compressor 10.

The compression unit includes a frame 12, a cylinder 13 fixed to the frame 12, and a piston 15 linearly reciprocating while being accommodated in the cylinder 13.

The frame 12, which is a part configured to fix the cylinder 13, may be configured integrally with the cylinder 13. In some examples, the cylinder 13 may be provided as a separate component and may be fixed to the frame 12 through a fastening member.

A compression space P in which the refrigerant is compressed by the piston 15 may be formed inside the cylinder 13. The cylinder 13 may have a cylindrical shape in which the compression space P may be provided, and may be formed in an extrusion rod processing scheme.

The piston 15 may be formed of the same material (aluminum) as that of the cylinder 13. While the compressor 10 is operated, an environment of a high temperature (about 100° C.) is provided in an interior thereof. At this time, because the piston 15 and the cylinder 13 are formed of the same material, and thus, have the same coefficient of thermal expansion, the piston 15 and the cylinder 13 may be thermally deformed by the same amount.

As a result, the piston 15 and the cylinder 13 are thermally deformed in different sizes or directions, so that an interference between the piston 15 and the cylinder 13 may be prevented when the piston 15 reciprocates.

In some examples, an oil feeder 19 configured to supply a lubricating oil to an inner circumferential surface of the cylinder 13 is provided on the floor of the lower shell 111. Oil supply passages 121 and 131 are provided inside the frame 12 and the cylinder 13, respectively.

For instance, an outlet of the oil feeder 19 communicates with the oil supply passage 121 of the frame 12, and the oil supply passage 121 communicates with the oil supply passage 131 of the cylinder 13. The oil supply passage 131 may be provided to connect an outer circumferential surface and the inner circumferential surface of the cylinder 13, and the lubricating oil supplied from the oil feeder 19 may be applied to the inner circumferential surface of the cylinder 13.

In some examples, the compression unit includes a suction muffler 40 mounted inside the piston 15. The suction muffler 40 may be formed of a non-magnetic material such as plastic, may have various kinds of noise spaces and noise pipes therein, and may attenuate noise having various frequencies as well as opening/closing noise of a suction valve which will be described below.

In some examples, because an internal structure of the suction muffler 40 is very complex, the suction muffler 40 is difficult to be processed or formed as a single body, and thus may be formed by coupling a plurality of members. In the present implementation, it is presented that the suction muffler 40 includes first to third mufflers 41 to 43.

The first muffler 41 is located inside the piston 15, and the second muffler 42 is connected to the first muffler 41 and is located on one surface of the piston 15. In some examples, the third muffler 43 is connected to the second muffler 42 on one side thereof and is connected to the inlet pipe 101 on the other side thereof.

For example, a working fluid (e.g., refrigerant), which is introduced into the sealed container 11 through the inlet pipe 101, may pass through the suction muffler 40 and be introduced into the piston 15. For instance, refrigerant may pass through the inlet pipe 101, the third muffler 43, the second muffler 42, and the first muffler 41, and may be introduced into the piston 15.

In some examples, refrigerant introduced into the piston 15 may be guided to the compression space P by a change in a pressure in the compression space P, which is caused by a linear reciprocating movement of the piston 15. This will be described below in detail.

In some examples, the compressor 10 may include a motor assembly 20 configured to provide a driving force to the piston 15. The motor assembly 20 may be directly connected to the piston 15 to allow the piston 15 to linearly reciprocate.

The motor assembly 20 may include an outer stator 21, an inner stator 22 provided inside the outer stator 21, and a magnet 23 interposed between the outer stator 21 and the inner stator 22. For instance, the outer stator 21 and the inner stator 22 are provided to surround the outer circumferential surface of the cylinder 13.

In some examples, the outer stator 21 includes a stator core 211 including a pair of blocks and a coil wound body provided inside the stator core 211. The coil wound body includes a bobbin 212 and a coil 213 wound in a circumferential direction of the bobbin 212.

One end of the outer stator 21 in an axial direction thereof is fixed to the frame 12, the other end of the outer stator 21 in the axial direction thereof is fixed to a motor cover 24, and the motor cover 24 is fixed to the frame 12 through a fastening member. That is, the motor cover 24 is provided to support one side of the outer stator 21.

The inner stator 22 may have a cylindrical shape surrounding the outer circumferential surface of the cylinder 13. One end of the inner stator 22 is in contact with the frame 12, and the other end of the inner stator 22 is fixed to the outer circumferential surface of the cylinder 13 by a fixing ring 14.

In some examples, an air gap may be defined between the outer stator 21 and the inner stator 22, and the magnet 23 is inserted into the air gap to linearly reciprocate.

For instance, the magnet 23 includes a plurality of permanent magnets that are arranged in an axial direction of the piston 15, and magnetic poles (N-S) are formed on surfaces facing the inner stator 22 and the outer stator 21.

In some examples, when an electric power is input to the coil wound body constituting the outer stator 21, an electromagnetic force is generated between the outer stator 21 and the inner stator 22, and the magnetic fluxes of the magnet 23 interact with each other to generate an attractive force and a repulsive force. Accordingly, the magnet 23 may linearly reciprocate.

The magnet 23 is connected to the cylinder 13 through a magnet frame 53. For instance, the magnet 23 is connected to the magnet frame 53, and an end of the piston 15 is connected to the magnet frame 53, so that the piston 15 and the magnet 23 may linearly reciprocate as one body.

In some examples, at least one of the frame 12, the cylinder 13, and the piston 15 may be formed of plastic which is a non-magnetic material. Any one of the frame 12, the cylinder 13, and the piston 15 is formed of a non-magnetic material, so that the frame 12, the cylinder 13, and the piston 15 may be prevented from being magnetized by a magnetic flux leaked from the motor assembly 20.

For example, as the piston 15 may be made of aluminum which is a non-magnetic material, use of a balance weight may be minimized because the mass scattering is smaller than that of a case where the piston 15 is formed using a cast product.

In some examples, the compressor 10 may include a resonance spring 16 elastically supporting the piston 15 in an axial direction to resonate the piston 15. One side of the resonance spring 16 is fixed to a back cover 17 provided on a rear side of the magnet frame 53, that is, an inlet side of the refrigerant.

In some examples, a M-K resonance frequency defined by a mass M of a movable member including the piston 15 and the magnet 23, a mechanical spring constant (Kmechanical) obtained by a restoring force of the resonance spring 16 supporting the same, and a gas spring constant (Kgas) and a magnetic spring constant (Kmagnet) obtained by a pressure of a working fluid introduced into the compression space P may be calculated. In some examples, the frequency of an electric power applied to the motor assembly is designed to follow the M-K resonance frequency so that efficiency of the compressor 10 may be optimized.

The magnetic spring constant Kmagnet may be a spring constant of a magnet spring. The magnetic spring may generate electromagnetic restoring force by which the magnet 23 may be located between the inner stator 22 and the outer stator 21. Because the electromagnetic restoring force is a force applied in the same direction as the restoring force of the resonance spring 16, the electromagnetic restoring force may be defined as the magnetic spring.

In some examples, the resonance spring 16 may include a first spring (e.g., a front spring) 161 placed between an end of the cylinder 13 and a flange 155 (see FIG. 4) of the piston 15 and a second spring (e.g., a rear spring) 162 placed between the magnet frame 53 and the back cover 17. In some examples, the first spring 161 and the second spring 162 may be arranged in a row.

In some examples, because the magnetic spring constant is important, the mechanical spring constant may be small. In some cases, to make the mechanical spring constant small, some of main springs or a supporter may be omitted, and only two springs arranged in a row may be applied as described in the present disclosure. As a result, the compressor may be miniaturized and lightened.

The first spring 161 and the second spring 162 may move in opposite directions to each other. In some examples, when the piston 15 moves toward a bottom dead center (BDC), for example, in a direction in which the compression space P is expanded, the first spring 161 may be restored to an original state thereof while being expanded, and the second spring 162 may accumulate a restoring force while being contracted. In other examples, when the piston 15 moves toward a top dead center (TDC), for example, in a direction in which the compression space P is contracted, the first spring 161 may accumulate the restoring force while being contracted, and the second spring 162 may be restored to an original state thereof while being expanded.

In some examples, floors of the first spring 161 and the second spring 162 are seated on spring seats 18. The spring seats 18 are provided in the flange 155 of the piston and the back cover 17 to support the first spring 161 and the second spring 162, respectively.

In some examples, opposite ends of the cylinder 13 may be defined as a distal end opened such that the piston 15 is inserted and a head as an opposite end to the distal end, through which the refrigerant is discharged.

In some examples, the compression unit of the compressor 10 includes a discharge valve assembly 30 seated on the head of the cylinder 13, a discharge muffler 52, and a discharge cover 51. As illustrated in FIG. 3, a cylindrical sleeve 132 extends from the head of the cylinder 13, and the discharge valve assembly 30 is seated inside the sleeve 132. In some examples, the discharge cover 51 and the discharge muffler 52 are seated outside the sleeve 132 to cover the discharge valve assembly 30.

The discharge valve assembly 30 is coupled to the head of the cylinder 13 to shield the compression space P. For instance, the discharge valve assembly 30 is seated in a stepped portion 132*a* formed on an inner surface of the sleeve 132.

The discharge valve assembly 30 is accommodated on one side of the sleeve 132 with respect to the stepped portion 132*a*, the compression space P is formed on the other side of the sleeve 132, and the head of the piston 15 is accommodated in the compression space P. The inner diameter of the sleeve 132 in which the discharge valve assembly 30 is accommodated is larger than the inner diameter of the cylinder 13 in which the piston 15 is accommodated, so that the stepped portion 132*a* may be provided.

In some examples, the compression space P may be defined as a space formed between a surface S2 passing through the head of the piston 15 and a surface S1 passing through the stepped portion 132*a*. In some examples, the compression space P is expanded or contracted by the linear reciprocating movement of the piston 15.

In some examples, when the compression space P is expanded most, the position of the surface S2 passing through the head of the piston 15 is referred to as the BDC, and when the compression space P is contracted most, the position of the surface S2 passing through the head of the piston 15 is referred to as the TDC.

The discharge cover 51 is included as a configuration of the discharge muffler 52. A cover gasket 136 may be interposed between the discharge cover 51 and the head of the cylinder 13. In some examples, the discharge muffler 52 and the discharge cover 51 may be fixed to the head of the cylinder 13 as one body through the same fastening member.

In some examples, the discharge cover 51 may include a cap 512 convexly rounded such that a discharge space D1 is formed therein, and a flange 511 may be bent and extend from a lower end of the cap 512. In some examples, a discharge hole 513 is formed at the center of the cap 512.

The high-temperature high-pressure refrigerant discharged from the discharge valve assembly 30 is discharged to the discharge space D1 formed in the cap 512. That is, the discharge valve assembly 30 may partition the compression space P and the discharge space D1 formed inside the cap 512.

In some examples, a valve spring 54 is placed inside the cap 512, and the valve spring 54 presses the discharge valve assembly 30. Accordingly, a predetermined preload may be applied to the compression space P inside the cylinder 13.

In some examples, a seal ring 130 is mounted on the head of the cylinder 13 on which the flange 511 of the discharge cover 51 is placed. Because an interior of the sealed container 11 has a relatively low pressure, the high-pressure refrigerant leaked from the discharge cover 51 should not be leaked to a low-pressure space inside the sealed container 11. Accordingly, the seal ring 130 is mounted so that the refrigerant discharged to the cap 512 of the discharge cover 51 may be prevented from being leaked to the outside of the discharge cover 51.

The discharge muffler 52 is coupled to the cylinder 13 and surrounds the cap 512 of the discharge cover 51. For instance, the discharge muffler 52 may be provided in one or plurality, and the mufflers are connected to each other by a loop pipe 55. In some examples, a discharge space D2 is also formed inside the discharge muffler 52. For instance, the discharge space D2 in which the high-temperature high-pressure refrigerant passing through the discharge hole 513 of the discharge cover 51 is collected is formed between the discharge cover 51 and the discharge muffler 52.

That is, the high-temperature high-pressure refrigerant discharged from the discharge valve assembly 30 is primarily discharged to the discharge space D1 formed inside the cap 512, and is then secondarily discharged to the discharge space D2 between the discharge muffler 52 and the discharge cover 51 through the discharge hole 513 formed in the cap 512. While the refrigerant moves from the cap 512 to the discharge space D2 between the discharge muffler 52 and the discharge cover 51, flow noise may be reduced.

In some examples, the discharge space D1 formed inside the cap 512 may be named a first discharge space D1, and the discharge space D2 between the discharge muffler 52 and the discharge cover 51 may be named a second discharge space D2.

As illustrated in FIG. 3, the discharge muffler 52 includes a main discharge muffler 521 and a sub discharge muffler 522. However, this is illustrative, and the form of the discharge muffler 52 is not limited thereto. That is, the discharge muffler 52 may be provided in various forms including a form in which the discharge muffler 52 includes a plurality of discharge mufflers.

A discharge port is formed on one side of the discharge muffler 52. In the present implementation, it is presented that a discharge port 522*a* is formed on one side of the sub discharge muffler 522. The same loop pipe as the loop pipe 55 is connected even to the discharge port 522*a*, and an outlet of the loop pipe connected to the discharge port 522*a* is connected to the outlet pipe 102.

The discharge valve assembly 30 includes a valve plate 31 seated on the stepped portion 132*a* and a discharge valve 33 placed on the front surface (or the upper surface) of the valve plate 31.

The valve plate 31 is provided in a shape of a plate having a circular front surface and a circular rear surface, and is coupled to the seal ring 32 on a side surface thereof. The seal ring 32 may be in close contact with an inner circumferential surface of the sleeve 132 to prevent the refrigerant from being leaked to a gap between the valve plate 31 and the sleeve 132.

Discharge holes 311 are formed through the center of the valve plate 31. The discharge holes 311 will be described in detail.

While the refrigerant is compressed and discharged, the valve plate 31 is maintained in a fixed state by a frictional force generated between the seal ring 32 and the inner circumferential surface of the sleeve 132. However, in a so-called "TDC searching" process of identifying a position of the TDC of the piston 15, the valve plate 31 is separated from the stepped portion 132*a* by a pressing force of the piston 15.

For instance, in the TDC searching process of identifying an accurate position of the TDC, the piston 15 moves to a position where the piston 15 pushes the valve plate 31. In some examples, when the valve plate 31 is pushed by the piston 15, the valve plate 31 is separated from the stepped portion 132*a* and is moved forward.

Accordingly, the valve spring 54 located in front of the valve plate 31 is compressed. At the same time, while the volume of the compression space P increases, the pressure in the compression space P instantaneously sharply drops. At this time, the position of the piston 15 at a time point when the pressure inside the compression space P sharply drops is determined as the TDC.

According to structural characteristics of the discharge valve assembly 30 according to the implementation of the present disclosure, because the pressure drop in the compression space P generated when the valve plate 31 moves is significantly larger than the pressure drop in the compression space P generated when the discharge valve 33 is opened, the position of the TDC may be easily identified.

The discharge valve 33 may be a flexible flap check valve including a disc-shaped valve body 332 and flaps 331 formed inside the valve body 332. The discharge valve 33 is seated on the front surface of the valve plate 31 and is provided in a form in which the flaps 331 close the discharge holes 311 of the valve plate 31.

As soon as the pressure in the compression space P becomes larger than the pressure in the discharge space D1 of the discharge cover 51, the discharge holes 311 are opened while the flaps 331 are bent. That is, the flaps 331 are provided to correspond to the shapes of the discharge holes 311, and the shapes of the flaps 331 will be described below in detail.

In some examples, a valve stopper 35 is provided on the front surface (e.g., the upper surface) of the discharge valve 33. The valve stopper 35 is formed to push edges of the discharge valve 33 and the valve plate 31, and function to restrain excessive bending of the flaps 331.

In some examples, the valve spring 54 functions to prevent the valve plate 31 from being separated from the sleeve 132 of the cylinder 13 by pressing an edge of the valve stopper 35.

Figure 4:
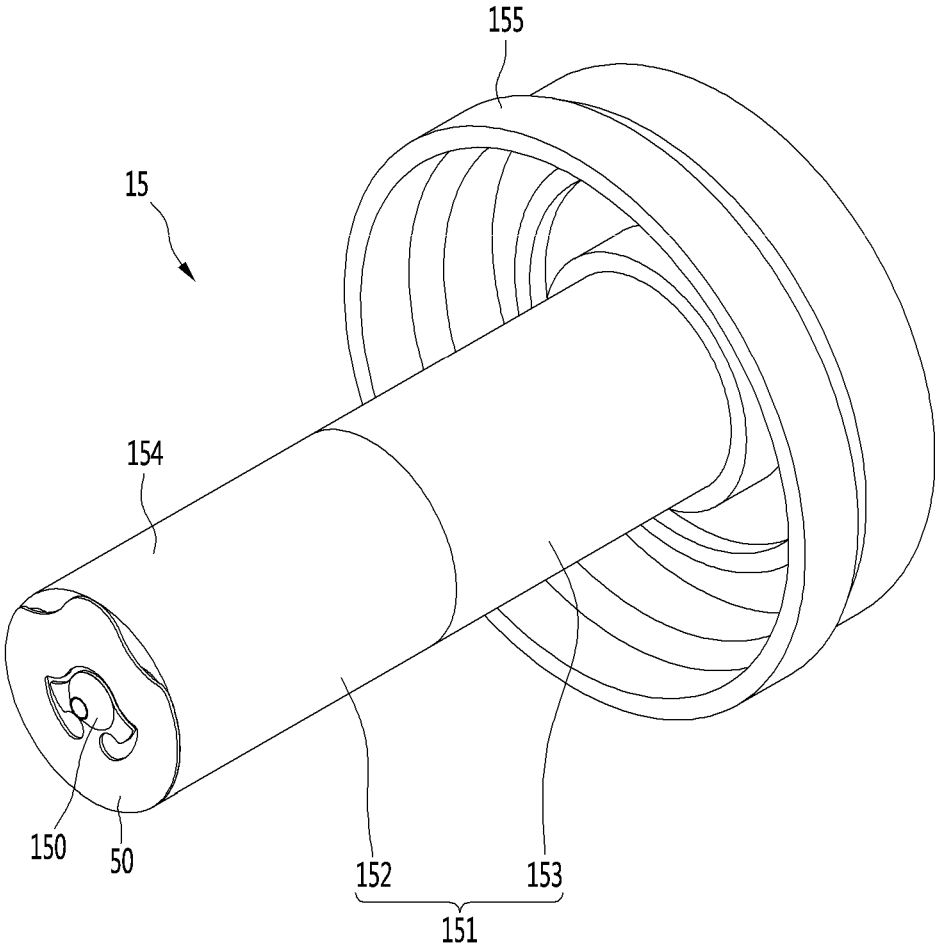
FIG. 4 is a perspective view illustrating an example coupling body of an example piston and an example suction valve of the example compressor.
Figure 5:
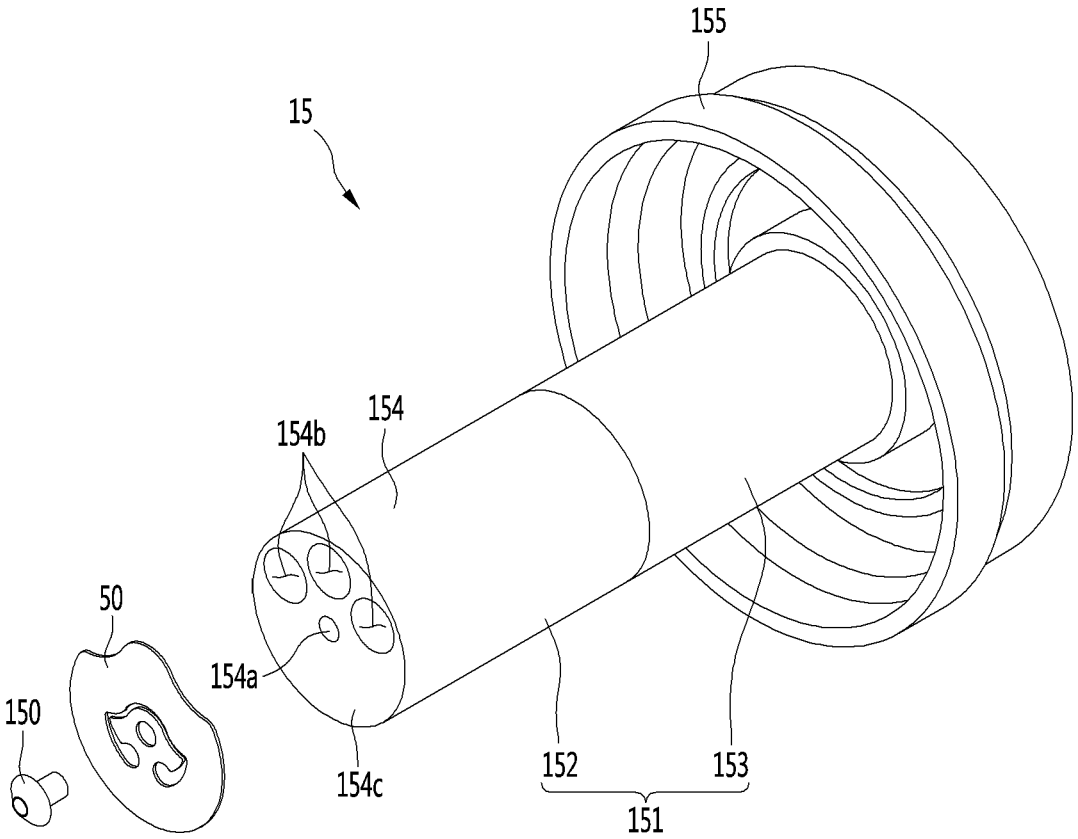
FIG. 5 is an exploded perspective view illustrating the piston and the suction valve of FIG. 4.

FIG. 4 is a perspective view illustrating a coupling body of a piston and a suction valve constituting the compressor according to the implementation of the present disclosure, and FIG. 5 is an exploded perspective view illustrating the piston and the suction valve of FIG. 4.

As described above, the piston 15 constituting the compressor 10 according to the implementation of the present disclosure may be provided to linearly reciprocate inside the cylinder 13 in a front-rear direction, and may be formed of a non-magnetic material of aluminum.

For instance, the piston 15 may include a cylindrical piston body 151 having a hollow portion formed therein, and a piston head 154 formed at one end of the piston body 151, and a flange 155 formed at the other end of the piston body 151.

An outer circumferential surface of the piston body 151 may be divided into a surface treated portion 152 and a surface untreated portion 153. The surface treated portion 152 may include a part with Teflon coating, and the surface treated portion 152 may prevent the piston 15 from being sharply and thermally expanded due to heat generated by friction between the piston 15 and the cylinder 13. In some examples, the surface untreated portion 153 corresponds to an area not inserted into the cylinder 13 and an area relatively far away from the compression space P, and the surface untreated portion 153 is not subjected to the Teflon coating, so that non-uniform expansion of the piston 15 may be minimized.

The piston head 154 includes a head surface 154*c* defining the compression space P. A bolt groove 154*a* may be formed at the center of the head surface 154*c*, and at least one suction hole 154*b* may be formed near an edge of the head surface 154*c* spaced apart from the bolt groove 154*a*. The refrigerant introduced into the hollow portion of the piston body 151 through the suction hole 154*b* is guided to the compression space P.

In some examples, a suction valve 50 may be seated on the head surface 154*c*, and the suction valve 50 may be fixed to the head surface 154*c* through a bolt 150. The bolt 150 passes through the center of the suction valve 50 and is inserted into the bolt groove 154*a*.

In some examples, a head of the bolt 150 may have a truncated cone shape. When the piston 15 moves forward to compress the refrigerant, the head of the bolt 150 may be inserted into the discharge hole 311 of the valve plate 31. As the head of the bolt 150 is inserted into the discharge hole 311, the refrigerant remaining in the discharge hole 311 may be effectively discharged. This will be described below in detail.

The suction valve 50 may be a flexible flap check valve, which is like the discharge valve 33. That is, due to a pressure difference between the compression space P and the hollow portion of the piston 15, which is generated when the piston 15 moves rearward, the suction valve 50 is bent so that the suction hole 154*b* is opened. In some examples, when the piston 15 moves forward, the suction hole 154*b* is closed by the pressure of the compression space P.

Figure 6:
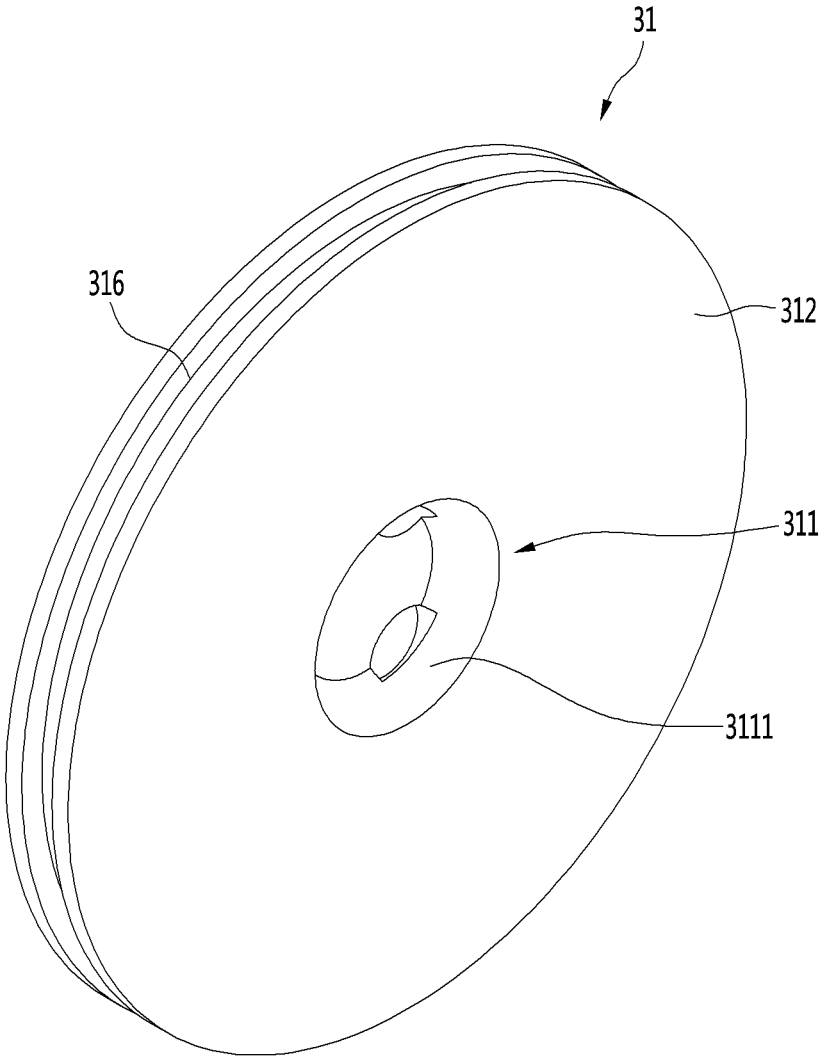
FIG. 6 is a view illustrating an example rear surface of an example valve plate.
Figure 7:
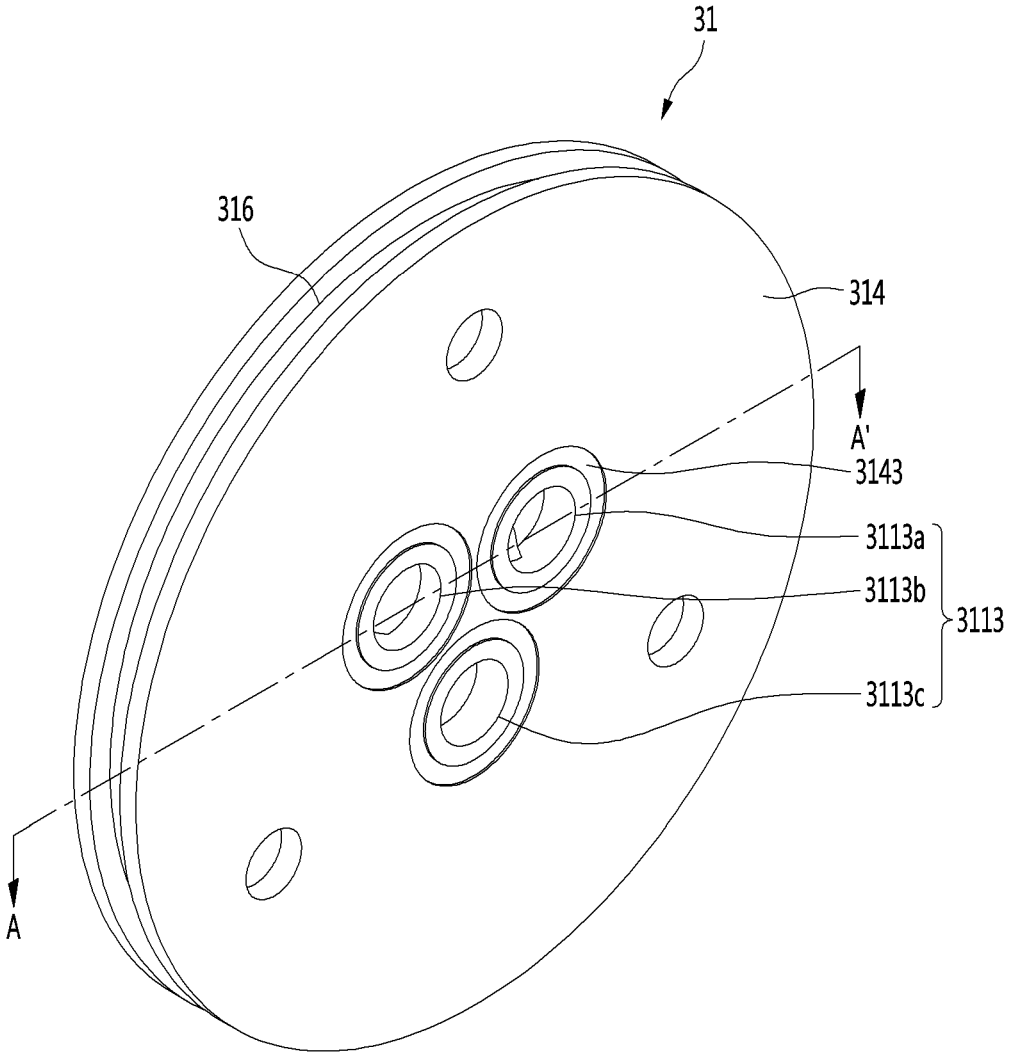
FIG. 7 is a view illustrating an example front surface of the valve plate.
Figure 8:
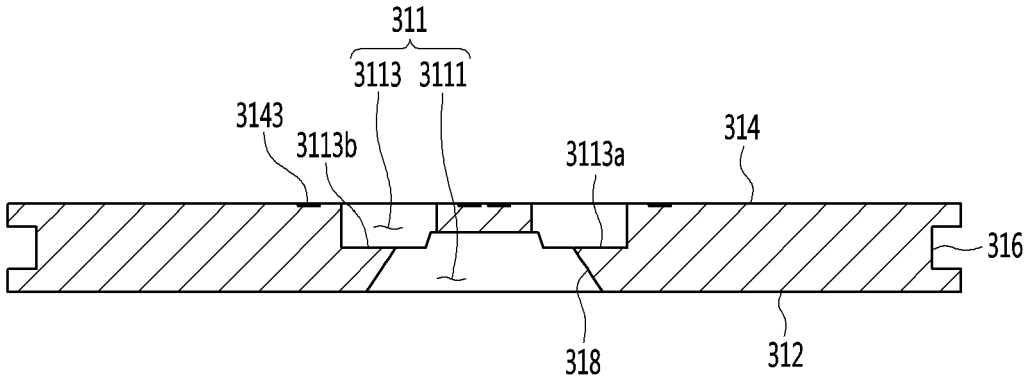
FIG. 8 is a sectional view taken along line A-A' of FIG. 7.

FIG. 6 is a view illustrating an example rear surface of an example valve plate, FIG. 7 is a view illustrating an example front surface of the valve plate, and FIG. 8 is a sectional view taken along line A-A' of FIG. 7.

As described above, the valve plate 31 is provided in the shape of a plate having a circular rear surface 312 and a circular front surface 314. At this time, the rear surface 312 is a surface through which the refrigerant is introduced, that is, a surface defining the compression space P, and the front surface 314 is a surface through which the refrigerant is discharged, that is, a surface defining the first discharge space D1.

That is, the rear surface 312 is a surface seated in the stepped portion 132*a* of the sleeve 132 of the cylinder 13 and located to be adjacent to the piston 15, and the front surface 314 is a surface on which the discharge valve 33 is installed and which is located to be adjacent to the valve spring 54 and the discharge cover 51.

In some examples, to prevent the valve plate 31 from being deformed by the high-temperature high-pressure refrigerant gas of the compression space P, the valve plate 31 may be formed of metal having high thermal resistance. As an example, the valve plate 31 may be formed of a cold-rolled steel plate.

In some examples, an insulation coating layer may be formed on the rear surface 312 of the valve plate 31, which is in contact with the compression space P. The insulation coating may be formed by a Teflon coating process. Accordingly, the valve plate 31 may be prevented from being deformed or damaged by the high-temperature high-pressure refrigerant, and transfer of heat of the compression space P to the discharge spaces D1 and D2 may be minimized.

In some examples, as described above, the seal ring 32 is coupled to a side surface of the valve plate 31. Thus, a sealing groove 316 to which the seal ring 32 is coupled may be provided on the side surface of the valve plate 31. The sealing groove 316 may be formed along the side surface of the valve plate 31.

Grooves 3143 formed outside the discharge holes 311 may be provided on the front surface 314 of the valve plate 31. The grooves 3143 are recessed in the front surface 314 of the valve plate 31 with a predetermined width. Oil mixed in the refrigerant may be introduced into the grooves 3143, and the grooves 3143 may maintain a state in which the oil is immersed therein.

While the discharge holes 311 are opened/closed, the flaps 331 of the discharge valve 33 collide with the valve plate 31. At this time, the oil collected in the grooves 3143 may perform a damping function of damping an impact applied to the flaps 331 and the valve plate 31. Accordingly, because the impact continuously applied to the flaps 331 is reduced, noise may be reduced, and a lifespan of the flaps 331 may be prolonged.

In some examples, as described above, the discharge holes 311 provided in the valve plate 31 are formed through the rear surface 312 and the front surface 314. The discharge holes 311 may be opened/closed by the discharge valve 33, and when the discharge holes 311 are opened, the refrigerant in the compression space P moves to the first discharge space D1.

In this way, in the compressor 10 according to the present disclosure, when the compressed refrigerant is discharged, the discharge valve 33 opens the discharge holes 311, so that the refrigerant in the compression space P is discharged to the discharge spaces D1 and D2 through the discharge holes 311. Thus, because a state in which the valve plate 31 is seated in the head of the cylinder 13 is maintained, noise when the refrigerant is discharged is reduced.

When the discharge valve 33 is opened and the discharge holes 311 are then closed, the compressed refrigerant located in inner spaces of the discharge holes 311 fails to be discharged. Such a space having the not-discharged compressed refrigerant refers to a dead volume. As the piston 15 moves rearward, the compressed refrigerant located in the dead volume is expanded in the compression space P again. Because this increases the pressure of the compression space P and prevents the refrigerant from being introduced into the compression space P, a cooling power is reduced. That is, the dead volume may be minimized to secure the cooling power.

In some examples, as a passage through which the refrigerant passes, that is, the cross sectional area of the discharge holes 311, becomes larger, flow passage resistance becomes smaller, so that an energy efficiency ratio (EER) may be improved. However, because the sizes of the discharge holes 311 may not be increased beyond a specific level due to the problem of valve reliability, the discharge holes 311 are provided in plurality to increase the cross sectional area.

For example, the volume of the discharge holes 311 may be minimized to secure the cooling power, and the plurality of discharge holes 311 need to be formed to improve efficiency. To satisfy all of these, the valve plate 31 may include an inlet 3111 and an outlet 3113 having different shapes.

The inlet 3111 is provided on a side of the rear surface 312 such that the refrigerant of the compression space P is introduced thereinto. The outlet 3113 is provided on a side of the front surface 314 such that the refrigerant passing through the valve plate 31 is discharged to the first discharge space D1.

That is, one end of the inlet 3111 is provided on the rear surface 312, the other end of the inlet 3111 is connected to the outlet 3113, one end of the outlet 3113 is provided on the front surface 314, and the other end of the outlet 3113 is connected to the inlet 3111.

The head of the bolt 150 of the piston 15 may be inserted into the inlet 3111. The dead volume may be reduced by a degree to which the head of the bolt 150 is inserted into the inlet 3111, so that the cooling power may be secured.

In some examples, to further reduce the dead volume, the shape of an inner circumferential surface of the inlet 3111 may be formed to correspond to the head of the bolt 150. As described above, the head of the bolt 150 may have a truncated cone shape. Accordingly, the inlet 3111 may include an inclined portion 318, the diameter of which decreases toward one direction. As illustrated in FIG. 8, the inclined portion 318 is formed such that the area of the inlet 3111 decreases as it goes from the rear surface 312 toward the front surface 314.

The shape of the head of the bolt 150 is illustrative, and the shape of the inner circumferential surface of the inlet 3111 is also illustrative. That is, the shape of the inner circumferential surface of the inlet 3111 may be variously provided to correspond to the shape of the head of the bolt 150.

The outlet 3113 includes a plurality of discharge ports 3113*a*, 3113*b*, and 3113*c*. For instance, as illustrated in FIG. 7, the outlet 3113 may include three discharge ports, and FIG. 8 illustrates a cross section cut showing the discharge ports 3113*a* and 3113*b* among the three discharge ports. The grooves 3143 may be provided at the discharge ports 3113*a*, 3113*b*, and 3113*c*, respectively.

The valve plate 31 may be manufactured by coupling a rear plate in which the inlet 3111 is formed and which extends from the rear surface 312 and a front plate in which the outlet 3113 is formed and which extends from the front surface 314. In some examples, the valve plate 31 may be manufactured such that the inlet 3111 and the outlet 3113 are formed on opposite sides in one flat plate.

Figure 9:
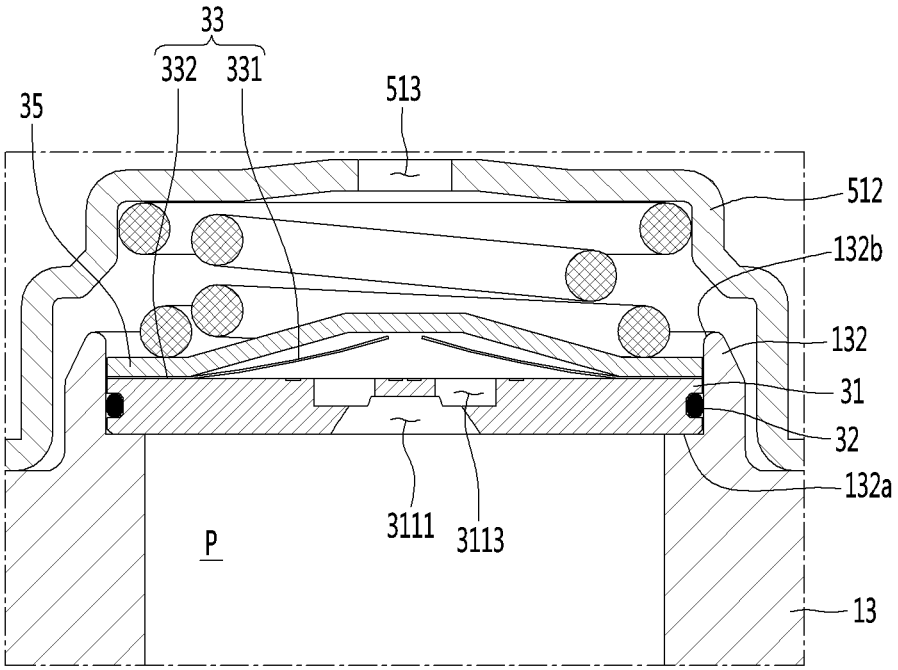
FIG. 9 is a view illustrating an example state in which the valve plate is mounted on an example head of an example cylinder.

FIG. 9 is a view illustrating an example state in which the valve plate is mounted on an example head of a cylinder.

Referring to FIG. 9, the valve plate 31 is mounted on the head of the cylinder 13. For instance, the valve plate 31 is inserted into the sleeve 132 provided in the head of the cylinder 13 while the seal ring 32 is coupled thereto. Further the stepped portion 132*a* is provided on an inner circumferential surface of the sleeve 132, and the valve plate 31 is seated in the stepped portion 132*a*.

The seal ring 32 coupled to the valve plate 31 is in close contact with the inner circumferential surface of the sleeve 132 to prevent the refrigerant from being leaked. Thus, it may be difficult to insert the valve plate 31 to which the seal ring 32 is coupled into the sleeve 132 during a manufacturing process. Thus, an end 132*b* of the inner circumferential surface of the sleeve 132 is inclined at a predetermined angle such that the valve plate 31 to which the seal ring 32 is coupled is easily inserted into the sleeve 132. Accordingly, the inner circumferential surface of the sleeve 132 has the largest inner diameter at the end 132*b*.

In some examples, the discharge valve 33 is mounted on an upper portion of the valve plate 31 mounted on the sleeve 132. As described above, the discharge valve 33 includes the valve body 332 and the flaps 331.

The flaps 331 are provided to have shapes corresponding to the discharge ports 3113*a*, 3113*b*, and 3113*c* to close the discharge ports 3113*a*, 3113*b*, and 3113*c*. That is, the three flaps 331 are provided to correspond to the illustratively provided three discharge ports 3113*a*, 3113*b*, and 3113*c* (see FIG. 7). In some examples, this is illustrative, and the shape of the discharge valve 33 including the flaps 331 may be variously provided to correspond to the shapes of the discharge ports.

In some examples, as described above, the valve stopper 35 configured to restrain excessive bending of the flaps 331 is installed at an upper portion of the discharge valve 33. The valve stopper 35 is provided to correspond to the shapes of the flaps 331 (see FIG. 3).

That is, the discharge valve 33 and the valve stopper 35 may be changed according to the shapes of the discharge ports 3113*a*, 3113*b*, and 3113*c*.

Figure 10:
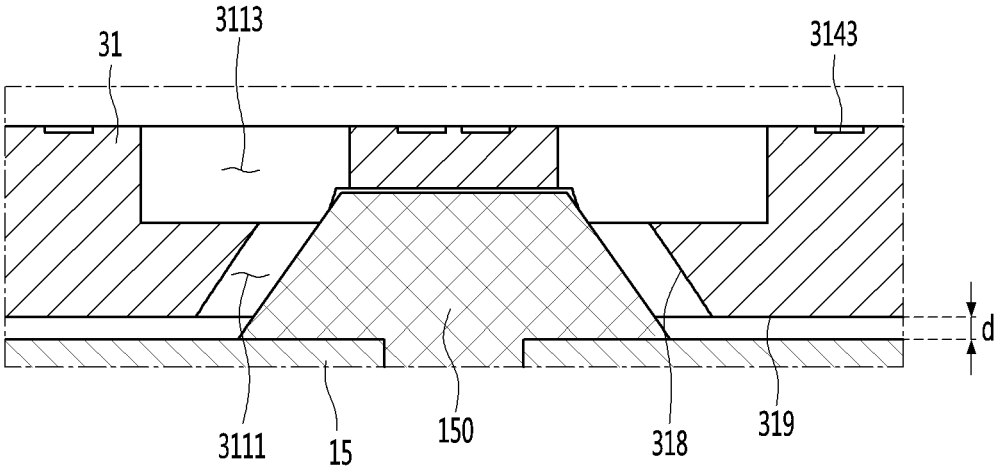
FIG. 10 is a view illustrating an example state in which an example bolt of the piston is inserted into an example discharge hole of the valve plate.

FIG. 10 is a view illustrating an example state in which an example bolt of the piston is inserted into an example discharge hole of the valve plate.

FIG. 10 illustrates a case where the compression space P is minimized, for example, a case where the piston 15 is located at the TDC. This illustrates an ideal driving situation of the compressor 10, and may be different from an actual driving situation of the compressor 10.

At this time, the head of the bolt 150 may be inserted into the discharge hole 311 of the valve plate 31. As the head of the bolt 150 is inserted into the discharge hole 311, the refrigerant remaining in the discharge hole 311 may be also effectively discharged.

As described above, the inlet 3111 is formed by the inclined portion 318 corresponding to the head of the bolt 150. The inclined portion 318 and the head of the bolt 150 may be inclined at the same angle.

In some examples, a stepped portion 319 may be formed in the inlet 3111 on a side of the rear surface 312. For instance, the stepped portion 319 may be recessed in the inlet 3111 with a predetermined depth d and a predetermined width. As an example, the depth d of the stepped portion 319 may be 0.2 mm.

As the stepped portion 319 is formed in the inlet 3111, a passage of the refrigerant introduced into the inlet 3111 is widened, so that flow passage resistance is reduced, while an increase in the dead volume in the discharge holes 311 may be minimized.

That is, as the head of the bolt 150 is inserted into the discharge hole 311, the inlet 3111 has a shape corresponding to the head of the bolt 150, and the stepped portion 319 is provided on a side of the rear surface 312, the dead volume may be reduced, and the cooling power may be secured.

In some examples, as the refrigerant passing through the one inlet 3111 is discharged from the outlet 3113 through the plurality of discharge ports 3113*a*, 3113*b*, and 3113*c*, flow passage resistance may be reduced, and efficiency may be secured.

The compressor 10, through the valve plate 31, which includes the front surface 314 and the rear surface 312 that have different shapes, may secure the cooling power and improve efficiency.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

a cylinder that defines an inner space;

a piston that is located in the inner space of the cylinder and that defines a compression space configured to receive refrigerant;

a discharge cover that is coupled to a side of the cylinder and that defines a discharge space configured to receive refrigerant discharged from the compression space;

a valve plate that is located in a side space defined at the side of the cylinder, that partitions the side space into the compression space and the discharge space, and that defines a discharge hole through which the compression space and the discharge space communicate with each other, the valve plate having a planar shape and defining a first surface that faces the compression space and a second surface that faces the discharge space; and a discharge valve located at the second surface of the valve plate and configured to open and close the discharge hole, wherein the discharge hole of the valve plate includes:

an inlet that faces the compression space, that is recessed from the first surface of the valve plate toward the second surface of the valve plate, and that is disposed at a center of the valve plate, the inlet having a first depth with respect to the first surface of the valve plate, and an outlet that faces the discharge space and that includes a plurality of discharge ports arranged about the center of the valve plate and recessed from the second surface of the valve plate toward the inlet, each discharge port having a second depth with respect to the second surface of the valve plate, wherein the inlet has a circular shape having a diameter that is greater than a diameter of each of the plurality of discharge ports, and a center of the inlet is radially spaced apart from a center of each of the plurality of discharge ports, wherein the first depth of the inlet is greater than the second depth of each of the plurality of discharge ports to allow the inlet to overlap with at least a portion of each of the plurality of discharge ports in an axial direction of the piston, wherein the discharge valve includes a plurality of flaps corresponding to the plurality of discharge ports, wherein the valve plate further defines grooves that are recessed from the second surface of the valve plate, that are spaced apart from each other, and that are configured to receive oil from refrigerant, the grooves surrounding the plurality of discharge ports, respectively, wherein the piston includes a bolt that is disposed at a center of a head surface of the piston, that has a side surface inclined with respect to the axial direction, and that is configured to insert into the inlet and at least the portion of each of the plurality of discharge ports in the axial direction, wherein the valve plate includes:

a center portion that is disposed at the second surface of the valve plate, that blocks the center of the valve plate, and that is configured to limit insertion of the bolt into the plurality of discharge ports, and an inclined portion that defines the inlet, that extends from the first surface of the valve plate toward the outlet, and that is configured to face the side surface of the bolt, and wherein the valve plate and the bolt are configured to, based on the bolt being located in the inlet, define a flow path that connects each of the plurality of discharge ports to a space between the inclined portion of the inlet and the side surface of the bolt.

2. The reciprocating compressor of claim 1, wherein each of the grooves has an inner edge that is spaced apart from an outer edge of one of the plurality of discharge ports.

3. The reciprocating compressor of claim 2, wherein the plurality of discharge ports are arranged about an axis of the cylinder.

4. The reciprocating compressor of claim 1, further comprising a valve stopper coupled to a side of the discharge valve and configured to limit movement of the plurality of flaps.

5. The reciprocating compressor of claim 4, wherein each of the plurality of flaps includes a first end that is coupled to the side of the discharge valve, and a second end that is configured to open and close one of the plurality of discharge ports.

6. The reciprocating compressor of claim 1, wherein the piston comprises:

a suction valve that is located between the bolt and the head surface of the piston, the head surface facing the compression space, and wherein the bolt couples the suction valve to the head surface of the piston.

7. The reciprocating compressor of claim 6, wherein the inlet has a shape corresponding to a shape of a head of the bolt, and wherein the inclined portion extends in parallel to the side surface of the bolt.

8. The reciprocating compressor of claim 6, wherein the piston defines a suction hole at the head surface of the piston, and wherein the suction valve is configured to open and close the suction hole based on movement of the piston.

9. The reciprocating compressor of claim 8, wherein the suction valve is configured to be bent to close the suction hole based on pressure in the compression space.

10. The reciprocating compressor of claim 1, wherein the plurality of discharge ports includes three discharge ports configured to communicate with the inlet.

11. The reciprocating compressor of claim 10, wherein the plurality of flaps includes three flaps that correspond to the three discharge ports, respectively, each flap being configured to open and close one of the three discharge ports.

12. The reciprocating compressor of claim 1, wherein the valve plate further defines a sealing groove that extends along a side surface of the valve plate, that is recessed toward the center of the valve plate, and that is configured to receive a seal ring, the side surface of the valve plate connecting the first surface of the valve plate and the second surface of the valve plate to each other.

13. The reciprocating compressor of claim 1, wherein an area of the inlet is greater than an area of each discharge port.

14. The reciprocating compressor of claim 1, wherein the diameter of the inlet decreases toward the outlet.

15. The reciprocating compressor of claim 1, wherein the bolt has a front end configured to insert into the inlet and a rear end disposed inside of the head surface of the piston, and wherein the piston defines a bolt groove recessed from the head surface of the piston and configured to receive the rear end of the bolt.

16. The reciprocating compressor of claim 1, wherein each of the grooves has a ring shape that surrounds one of the plurality of discharge ports, each of the grooves having an outer edge and an inner edge that are coplanar with the second surface of the valve plate.

17. The reciprocating compressor of claim 16, wherein each of the plurality of discharge ports has an edge that is spaced apart from an edge of another of the plurality of discharge ports, and wherein the edge of each discharge port is coplanar with the outer edge and the inner edge of each of the grooves.

18. The reciprocating compressor of claim 1, wherein an axial thickness of the center portion of the valve plate is less than the second depth of each of the plurality of discharge ports.

* * * * *